United States Patent [19]

Toda et al.

[11] Patent Number: 4,592,495

[45] Date of Patent: Jun. 3, 1986

[54] AUTOMATIC GUN FOR DISCHARGING THERMOPLASTIC RESIN

[75] Inventors: Masaaki Toda, Kawasaki; Yoshio Ichikawa, Yokohama, both of Japan

[73] Assignee: Nordson Corporation, Amherst, Ohio

[21] Appl. No.: 450,260

[22] Filed: Dec. 16, 1982

[30] Foreign Application Priority Data

Dec. 29, 1981 [JP] Japan ..... 56-215170

[51] Int. Cl.[4] ..... B67D 3/00

[52] U.S. Cl. ..... 222/526; 222/146.5; 901/43; 285/276; 285/281

[58] Field of Search ..... 222/526, 527, 529, 533, 222/536, 146.5; 901/30, 41–43; 285/276, 281

[56] References Cited

U.S. PATENT DOCUMENTS

| | | | |
|---|---|---|---|
| 1,128,798 | 2/1915 | McLaughlin | 285/168 |
| 2,240,458 | 4/1941 | Grise | 222/236 X |
| 2,270,928 | 1/1942 | Browne | 285/276 |
| 2,379,035 | 6/1945 | Phillips | 285/168 X |
| 2,384,360 | 9/1945 | Allen et al. | 285/276 X |
| 2,394,715 | 2/1946 | Phillips | 285/276 X |
| 2,414,997 | 1/1947 | Atkins | 285/97.3 |
| 2,518,216 | 8/1950 | Barker | 285/98 |
| 2,587,938 | 3/1952 | Warren | 285/168 X |
| 2,812,960 | 11/1957 | Walsh | 285/276 |
| 2,817,543 | 12/1957 | Corsett | 285/281 |
| 2,879,083 | 3/1959 | Corsette | 285/168 X |
| 3,303,972 | 2/1967 | Van Loben Sels | 222/529 X |
| 3,405,959 | 10/1968 | Walker | 285/276 |
| 3,473,832 | 10/1969 | Kreidel, Sr. et al. | 285/98 |
| 4,245,759 | 1/1981 | Baker et al. | 222/146.5 |
| 4,313,624 | 2/1982 | Zierden et al. | 285/276 X |
| 4,323,269 | 4/1982 | Pellenc | 285/276 X |
| 4,378,959 | 4/1983 | Susnjara | 901/43 X |

FOREIGN PATENT DOCUMENTS 937178 8/1948 France .

OTHER PUBLICATIONS

ASEA IRB 6/2 Robot, "Robot Gluing" filed in 10/13/83.

*Primary Examiner*—Joseph J. Rolla
*Assistant Examiner*—Kevin P. Shaver
*Attorney, Agent, or Firm*—Wood, Herron & Evans

[57] ABSTRACT

An automatic hot melt adhesive dispensing gun is connected by a swivel assembly to a working arm of a programmable working machine. The swivel assembly includes a hollow spindle journalled in the gun block of the gun. The free end of the spindle is connected to a hot melt adhesive source via a hose. The gun block rotates relative to the spindle. The gun can thus move in response to the movement of the working arm without exerting harmful torques on the hose.

6 Claims, 17 Drawing Figures

PRIOR ART 11
12
14
18
C
C
A2
17

AUTOMATIC GUN FOR DISCHARGING THERMOPLASTIC RESIN

BACKGROUND OF THE INVENTION

The present invention relates to a connecting mechanism for a thermoplastic resin supply hose in an automatic gun for discharging thermoplastic resin.

Generally speaking, an automatic gun for thermoplastic resin is often used for hot melt, and the explanation pertains to the use of hot melt. Hot melt is simply thermoplastic resin, and its materials include EVA-based, saturated polyester-based, polyamid-based, and polyolefin-based materials, other copolymers or their modified products, and rubber-based materials without vulcanization such as butyl rubber, polyisobutylene rubber, polybutene, SBR, etc. Since all of the above materials have great adhesive power, they are used in many fields such as for joint sealing, for the assembling of laminated paper consisting of paper, plastics, metal, wood, ceramics, etc., and for assembly work involving various types of plates, unwoven cloth, chinaware, packing bags and boxes, plastic building materials, machinery tool parts, glass products, etc. The materials are spread as an adhesive or sealing agent by means of a hot melt applicator.

Further objects and features of the invention will be apparent from the following description of the specific embodiment of the invention in connection with the accompanying drawings. It should be understood that this description is in no way limiting and that various changes may be brought to the disclosed embodiment without departing from the scope of the invention.

DETAILED DESCRIPTION OF A SPECIFIC EMBODIMENT

Figure 1A:
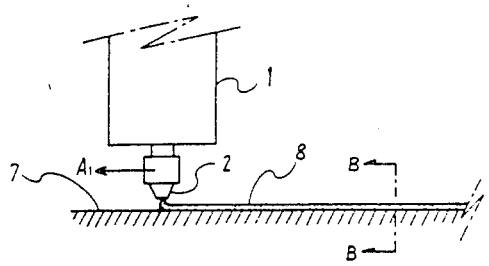
PRIOR ART Fig 1A
FIG. 1A is a side view which explains the former discharge situation for hot melt.
Figures 1B, 1C, 1D, 1E:
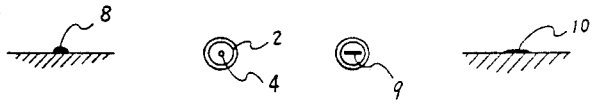
FIG. 1B shows the cross section B—B of FIG. 1A.
FIG. 1C is a front view of a circular nozzle (the base of the nozzle) for hot melt.
FIG. 1D is a front view (the bottom of a nozzle) of a slit-type nozzle for hot melt.
FIG. 1E is a cross section of a band obtained by the use of a slit-type nozzle shown in FIG. 1D to spread hot melt.
Figure 11:
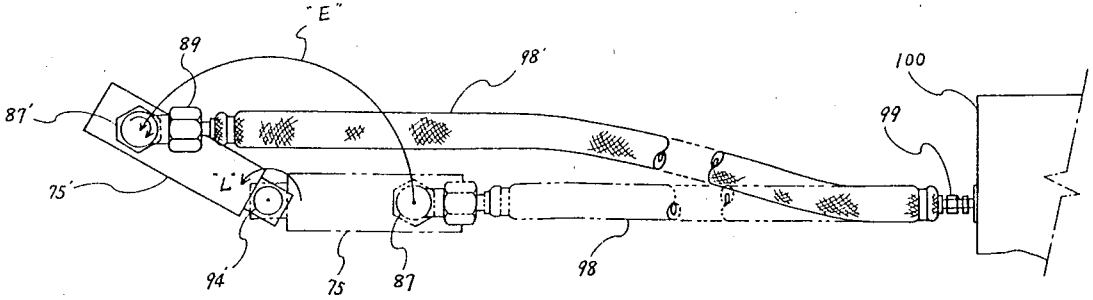
FIG. 11 is a ground plan of the action of FIG. 10.

The emitting and spreading conditions are illustrated for the uses described above in FIG. 1A. Hot melt is emitted and spread on the surface of the material to be assembled by a dispenser 1 by locating the hot melt-emitting nozzle 2 close and almost perpendicular to said surface and by moving it in a certain direction $A_1$ (or by moving the material to be assembled past the nozzle). In this case, the discharge hole of the nozzle is either in the shape of a circle 4 (in FIG. 1C) or a slit 9 (FIG. 11). The material is discharged as strips 8, whose section is semi-circular as shown in FIG. 1B when the discharge hole is circular or flat 10 as shown in FIG. 1E when the hole is slit-shaped. When the discharge hole is circular, the nozzle can be moved in any direction. When the hole is a slit, however, the nozzle is often moved in a line, since it is necessary to provide for perpendicular motion; that is; the slit is undirectional. In other words, it is impossible to emit thermoplastic resin in all directions through a slit-type nozzle.

Furthermore, a strong demand has developed not only for emitting adhesives, but also for forming bands with a specific sectional shape (hereafter referred to as profile), i.e., with a two- or three-dimensional shape for the emitted outline of the band.

Figures 2A, 2B, 2C:
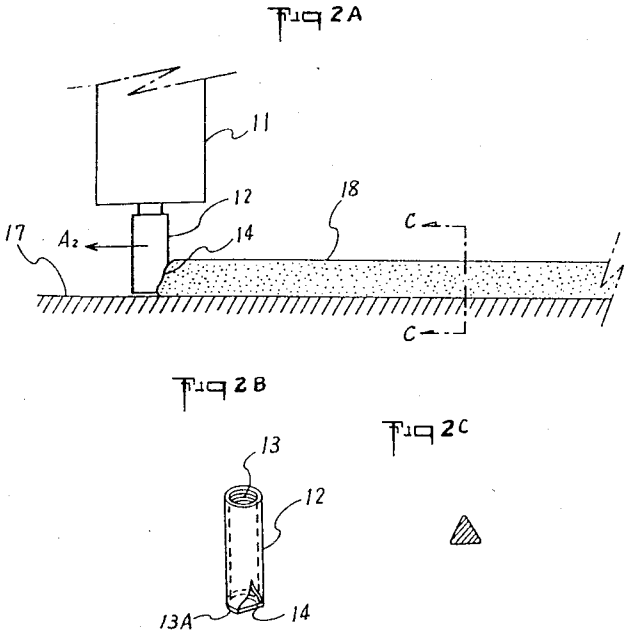
FIG. 2A is a side view which explains the action of the tube-type nozzle installed on the automatic gun of the present invention.
FIG. 2B shows an external view of said tube-type nozzle.
FIG. 2C shows section C-C of FIG. 2A.

A nozzle is preferred in which the nozzle hole faces one direction in the side wall of the nozzle to discharge and spread bands with a complex profile. The outline of such a nozzle is explained in the following. As shown in FIG. 2B, the nozzle 12 is made in the shape of a tube with a top end having threads 13 therein and a bottom end 13A. A nozzle hole 14 is located in one of the side walls of this nozzle.

The conditions under which hot melt is discharged and spread from a dispenser 11 through said nozzle are illustrated in FIG. 2A. A hot melt band 18 is discharged and molded through said nozzle by moving said nozzle in a certain direction $A_2$; that is the required profile is discharged, applied, spread, and adhered to the surface of the material to be assembled 17. In this case, the nozzle must move in a direction $A_2$ opposite to the direction in which the above-mentioned nozzle hole 14 points. Therefore, when the outline of a hot melt band to be emitted must be curved, the direction of nozzle movement must change along this curve part by part. When hot melt bands for sealing in particular are to be emitted, a nozzle, that is, a gun, which is housed in a body with said nozzle, must be ultimately rotated by 360°, since most bands are of the profile type and are endless.

Figure 3:
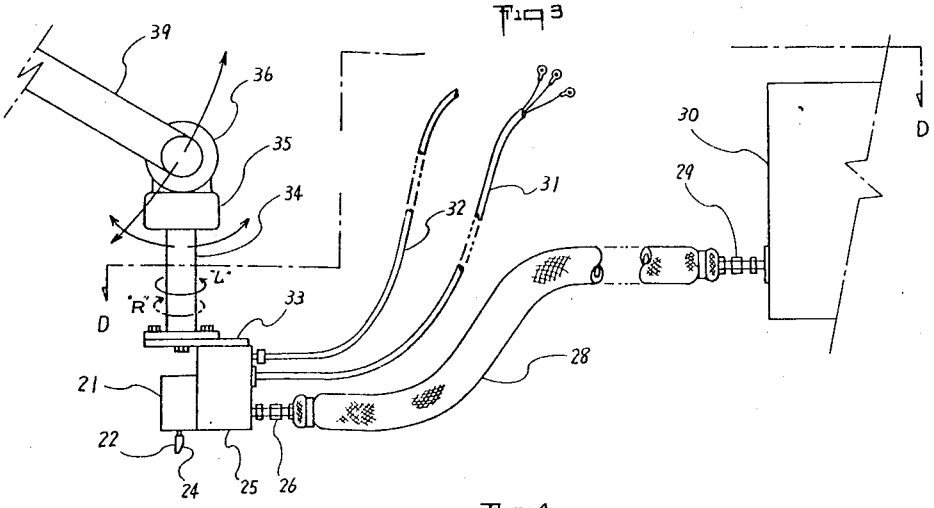
FIG. 3 is a side view of a former automatic gun installed at the tip arm of an industrial robot.
Figures 5, 6, 7:
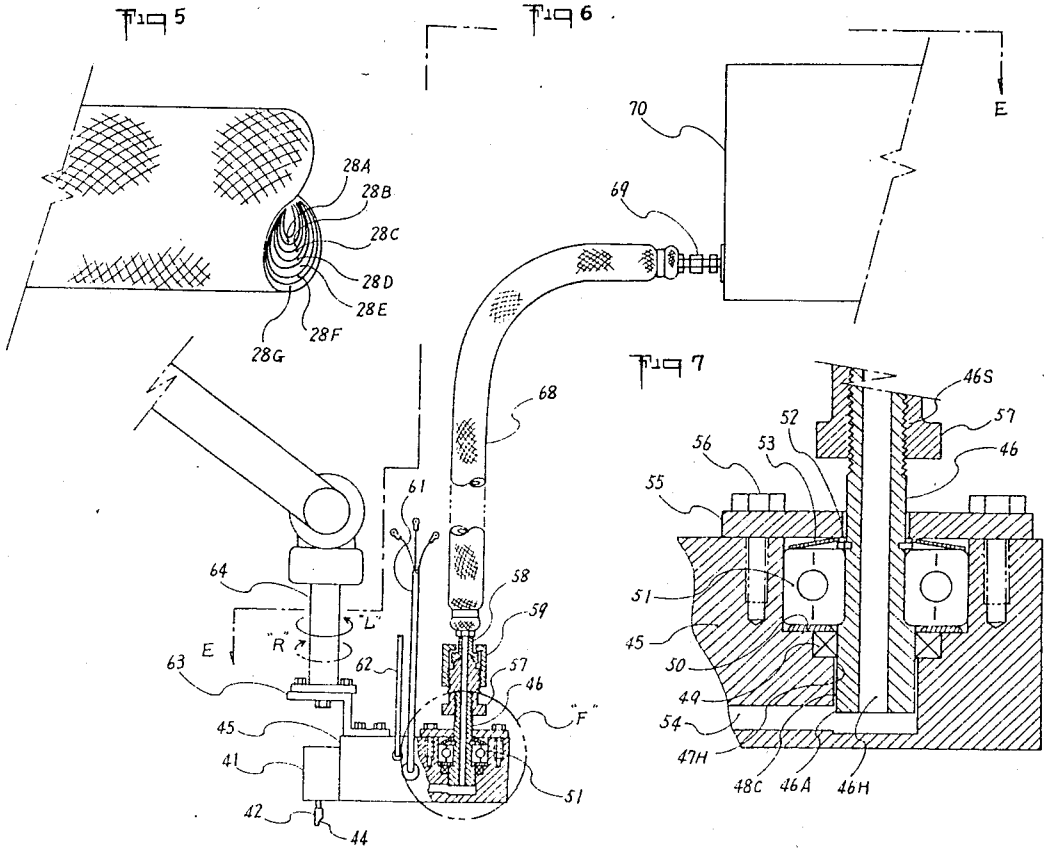
FIG. 5 illustrates the design of the hot melt supply hose.
FIG. 6 is a side view sectional drawing of the connection between the automatic gun of the present invention and the hot melt supply hose.
FIG. 7 is a detailed drawing of the "F" portion of FIG. 6.

However, this is impossible with the former hot melt gun. FIG. 3 illustrates the case in which the former hot melt gun is installed on an industrial robot 35. Industrial robot 35 includes arms 34 and 39 joined at joint 36. In FIG. 3, the symbol 25 represents the gun body; 21 is the hot melt emitting valve installed on said gun body; and 22 is the nozzle installed at the lower portion of said valve, which is of the tube type and has a nozzle hole 24 in one of its side walls (on the right side of the figure). The gun body is connected to arm 34 of the industrial robot by a connector 33. A hot melt supply hose 28 is attached to the above gun body by a fitting 26 and is connected to a hot melt applicator 30 by another fitting 29. This hose must not only be heat-resistant and pressure-resistant, but must also be insulated, automatically temperature-controlled, and slightly flexible. That is to say, the hose is constructed of seven layers as shown in FIG. 5. These layers are, from the inner layer to the outer layer, a Teflon tube 28A, a stainless tube 28B, insulation tape 28C, a band heater 28D, foamed silicone 28E, Nylon netting 28F, and shrink rubber 28G. Therefore, the hose is relatively thick and is not very flexible. In addition, a flexible conduit 31 and an air hose 32 are connected to the above gun body.

Figure 4:
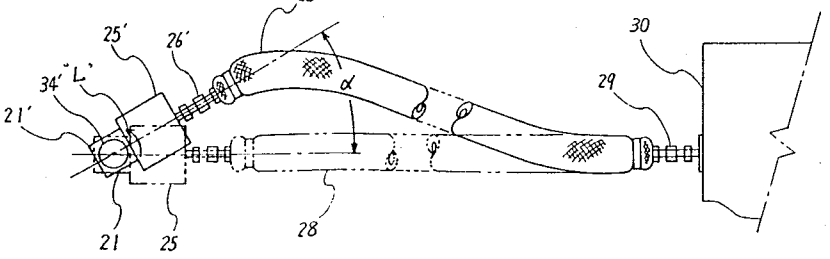
FIG. 4 is a ground plan to explain the action of the automatic gun shown in FIG. 3.

When the above gun body rotates around the arm 34 of an industrial robot, the wiring conduit and the air hose can follow easily, since they are very flexible as shown in FIG. 4; but the hot melt supply hose has a very small rotation angle because of its thickness. As described above, therefore, it is impossible for the hose to rotate 360°.

It is the purpose of the present invention to provide a swivel connection for the above automatic gun body and the thermoplastic resin (hot melt) supply hose by providing a hollow spindle, which is supported and sealed with bearings and an O-shaped seal in said automatic gun body, and which projects slightly from said automatic gun body, and by connecting said hollow spindle and the above thermoplastic resin (hot melt) supply hose by means of metal connector fittings in the connecting portion between the thermoplastic resin (hot melt) supply hose and the automatic gun body.

The present invention is summarized by the concept of installing a hollow spindle, which is supported and sealed with bearings and an O-shaped seal in an automatic gun body, and of connecting the projecting portion of said hollow spindle by means of metal fittings located at the end of a thermoplastic (hereafter referred to as hot melt) supply hose. Therefore, it is possible for hot melt supplied from the above hot melt supply hose to pass through the above hollow spindle and always reach the gun body even when the hollow spindle is rotating. That is to say, the automatic gun body can be freely rotated by freeing the nozzle, even when hot melt is being supplied. In other words, it is possible to change the discharge direction freely from the nozzle and easily to provide endless profile-type bands with any desired outline.

The structure of the present invention is explained in the following on the basis of FIGS. 6 and 7. An automatic gun body 45 provides air for operating an air valve, electricity for operating said air valve and an electromagnetic valve, etc., and supplies hot melt to a discharge valve 41, which is connected to the body. A hollow spindle 46 for supplying hot melt is first installed in the above automatic gun body 45, and said hollow spindle is supported in bearings 51. A bearing plate 50, a bearing washer 53, and a snap ring 52 are attached as accessory metal fittings for these bearings. A bearing cover 55 is bolted by bolts 56 to gun body 45. An O-shaped seal 49 is attached to the lower portion of the bearings of the hollow spindle supported as described above. The necessary properties of the O-shaped seal include heat resistance (above 300° C.) and pressure resistance (about 100 kg/cm$^2$). The gap 48C between the outer diameter of the hollow spindle 46 and the hole to hold the hollow spindle 47H is tightly sealed. The hollow portion 46H of the bottom 46A of the hollow spindle is open and connected to the path 54 leading to the discharge valve 41. The upper portion of the above hollow spindle projects slightly beyond the automatic gun body, and a male screw thread 46S is cut in it. This male screw thread is connected to a metal connector fitting 57 located at the end of the hot melt supply hose 68. Although not shown in the figures, a rotary joint for air and a rotary contact for electricity can be installed whenever deemed necessary, since the above-mentioned flexible conduit 61 and air hose 62 have relatively great flexibility. A flange 63 is bolted to the tip arm 64 of the robot and the gun body 45 so that the rotation of the tip arm 64 rotates the gun body 45.

Figure 8:
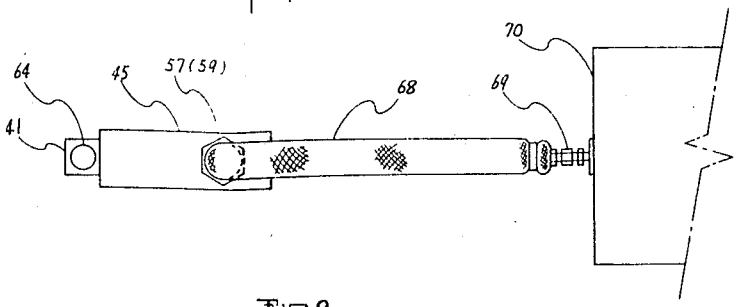
FIG. 8 is a ground plan of FIG. 7.
Figure 9:
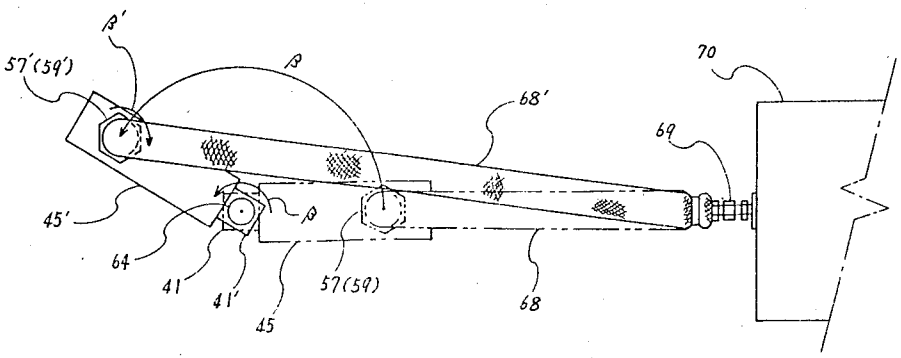
FIG. 9 illustrates a drawing to explain the action in FIG. 6 (and FIG. 8)

The action of the automatic gun of the present invention is explained in the following on the basis of FIGS. 6 and 8. FIG. 8 is a ground plan of FIG. 6. Hot melt (including bulk melt) is melted by a hot melt applicator 70 and moved through a hot melt supply hose 68 by means of a pressurized transfer pump. Hose 68 is connected to applicator 70 by fitting 69. The hot melt flows through the metal connector fittings 57, 58, 59, located at the end of the above supply hose, through the hollow spindle 46 and into the path 54 leading to the discharge valve 41 of the automatic gun 45. When the tip arm 64 of an industrial robot rotates around its axis (concentric to the axis of the nozzle 42) by a certain angle B, the automatic gun body also rotates by the same angle as shown in FIG. 9. In such a case, the above hollow spindle 46 also follows and rotates by the angle B. The hose will not restrict the motion, because there is enough looseness so that the hot melt supply hose 68 can follow easily. That is to say, it can easily rotate 360° around the nozzle.

Figure 10:
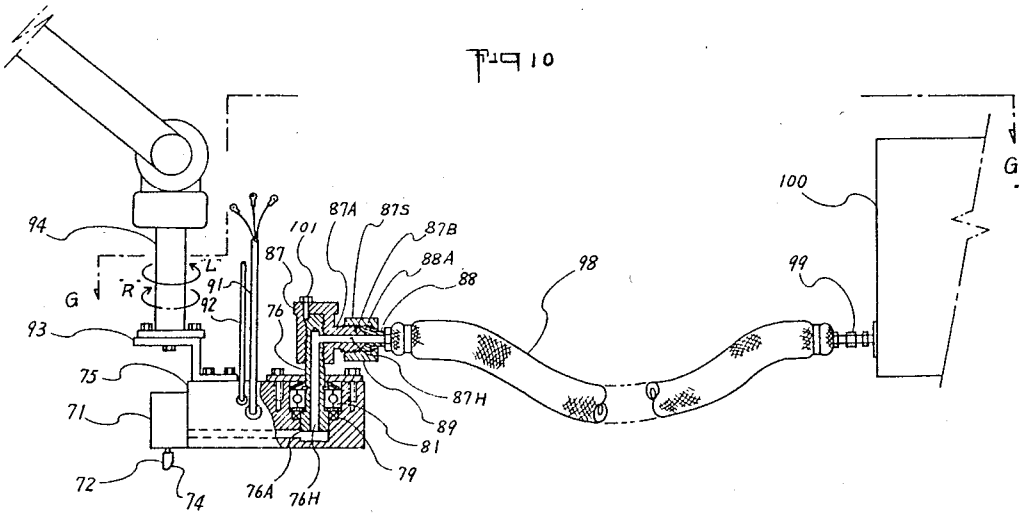
FIG. 10 is a side view sectional drawing of the use of an elbow type metal fitting for the hot melt supply hose.

The coupling between hot melt supply hose and the automatic gun body described above is based on the connection with straight tube-type metal fittings, but it is naturally possible to connect them with elbow type metal fittings. Its sectional diagram is shown in FIG. 10. This type of fitting functions exactly like the straight tube-type metal fittings as shown in FIG. 11, and therefore a detailed explanation is omitted. However, the following elements and reference numerals correspond: hot melt supply hose 98, fitting 99, applicator 100, metal connector fittings 88A, 87B, 87S, 87A, 87, 88, 89, bearings 81, O-shaped seal 79, hollow 76H, hollow 87H, bolt 101, spindle 76, spindle bottom 76A, nozzle 72, nozzle hole 74, discharge valve 71, gun body 75, flexible conduit 91, air hose 92, robot arm 94, and flange 93.

In the above description, thermoplastic resin has been explained in the form of hot melt, but it is obvious that other general thermoplastic resins can also be used. Adhesive power is not always required for bands of sealing materials, spacers, etc. The use and operational conditions for general thermoplastic resins are exactly the same as for the hot melt described above, and their explanation is omitted.

As described above, a swivel connector type automatic gun of the present invention makes it possible to rotate the automatic gun freely around the nozzle while supplying molten thermoplastic resin to said automatic gun body and to discharge a thermoplastic resin band with a given profile and to spread said band in any outline onto the surface of the material to be treated.

While we have disclosed specific embodiments of our invention, persons skilled in the art to which this invention pertains will readily appreciate changes and modifications which may be made in the invention. Therefore, we do not intend to be limited except by the scope of the following appended claims.

What is claimed is:

1. An automatic fluid dispenser mounted to a mover for dispensing fluid received from a hose, the dispenser comprising a gun block, rotatable by said mover about an axis, a nozzle means for dispensing fluid and mounted to said gun block on said axis, a spindle rotatably mounted to said gun block and disposed parallel to said axis, said spindle and gun block placing the hose and nozzle means in fluid communication; said spindle connected to the hose so that said gun block rotates relative to the hose, and means for mounting said gun block to the mover.

2. An automatic fluid dispenser as in claim 1, wherein said gun block is rotatable by said mover through substantially 360°.

3. An automatic fluid dispenser as in claim 1, wherein said spindle is spaced from said axis.

4. An automatic fluid dispenser as in claim 1, said nozzle means having an outlet for dispensing fluid in a direction normal to said axis.

5. An automatic fluid dispenser as in claim 4, wherein said fluid is dispensed in bead form from said nozzle in said direction normal to said axis, said nozzle outlet bearing a uniform orientation to said dispensed bead for all rotational movements of said gun block about said axis.

6. A fluid dispensing system for use with a movable working arm of a programmable working machine for uniformly dispensing, for all relative movement of said system about a first axis of rotation thereof, a fluid bead in a direction normal to said axis, and said system comprising:

a gun block mounted to the working arm so as to be movable with, and rotatable about said axis by, the working arm;

a nozzle, through which a fluid bead is dispensed, attached to said gun block;

said gun block having a passage communicating with said nozzle;

a source of fluid;

a hose operably connecting said source to said gun block passage and said nozzle;

said gun block being rotatable by said working arm about said first axis, and said nozzle being disposed to dispense said fluid bead in a direction perpendicular to said axis; and a spindle rotatably mounted to said gun block on a second axis parallel to said first axis and spaced therefrom, said hose having an end operably connected to said spindle coaxially with said second axis, and said nozzle being mounted on said first axis.

* * * * *